US005861855A

United States Patent [19]

Arsenault et al.

[11] Patent Number: 5,861,855

[45] Date of Patent: Jan. 19, 1999

[54] METHOD AND APPARATUS FOR DE-ICING A SATELLITE DISH ANTENNA

[75] Inventors: Robert G. Arsenault, Redondo Beach; James D. Allen, Westlake Village; David J. Kuether, Walnut, all of Calif.

[73] Assignee: Hughes Electronics Corporation, El Segundo, Calif.

[21] Appl. No.: 790,881

[22] Filed: Feb. 3, 1997

[51] Int. Cl.[6] ..... H01Q 1/02

[52] U.S. Cl. ..... 343/704; 343/703

[58] Field of Search ..... 343/704, 703; H01Q 1/02

[56] References Cited

U.S. PATENT DOCUMENTS

| | | | |
|---|---|---|---|
| 4,593,273 | 6/1986 | Narcisse | 340/539 |
| 4,890,332 | 12/1989 | Takahashi | 455/67 |
| 5,239,684 | 8/1993 | Ishikura | 455/67.7 |
| 5,386,587 | 1/1995 | Yuzawa | 455/3.2 |
| 5,509,081 | 4/1996 | Kuusama | 381/103 |
| 5,630,218 | 5/1997 | Muto | 45/226.2 |

FOREIGN PATENT DOCUMENTS

| | | | |
|---|---|---|---|
| 57-99806 | 6/1982 | Japan | 343/704 |
| 63-187704 | 8/1988 | Japan | H01Q 1/02 |
| 1-311701 | 12/1989 | Japan | H01Q 1/02 |
| 4-293303 | 10/1992 | Japan | H01Q 1/02 |

*Primary Examiner*—Don Wong
*Assistant Examiner*—Hoang Nguyen
*Attorney, Agent, or Firm*—John A. Crook; Michael W. Sales

[57] ABSTRACT

A method and system for controlling a heating device mounted on e.g. a satellite receiver antenna is disclosed. The method includes the steps of determining whether the signal strength is degrading, determining whether a temperature is below a threshold temperature, and operating a heating device on the antenna only if the signal is degrading and the temperature is below the threshold. The system includes a temperature sensor that samples a relevant temperature, a device that measures a signal strength of a signal received by the antenna, logic in communication with the temperature sensor and the measuring device for determining whether both the signal strength is degrading and the sample temperature is below a threshold temperature, and a control or switch device for operating a corrective device, such as a heater. The system and method herein automatically turns on an antenna heating device or other device to melt snow or frost accumulated on the receiver antenna upon detecting a loss of signal strength and a sufficiently low temperature.

25 Claims, 5 Drawing Sheets

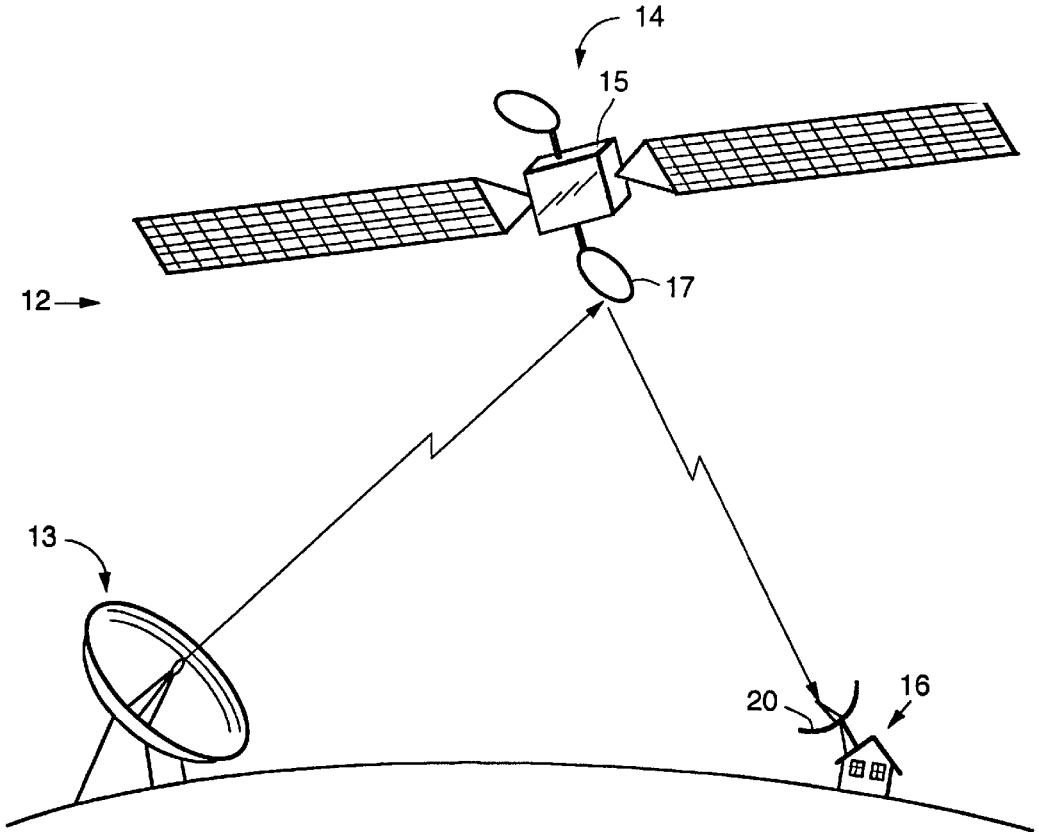
FIG. 1
FIG.7
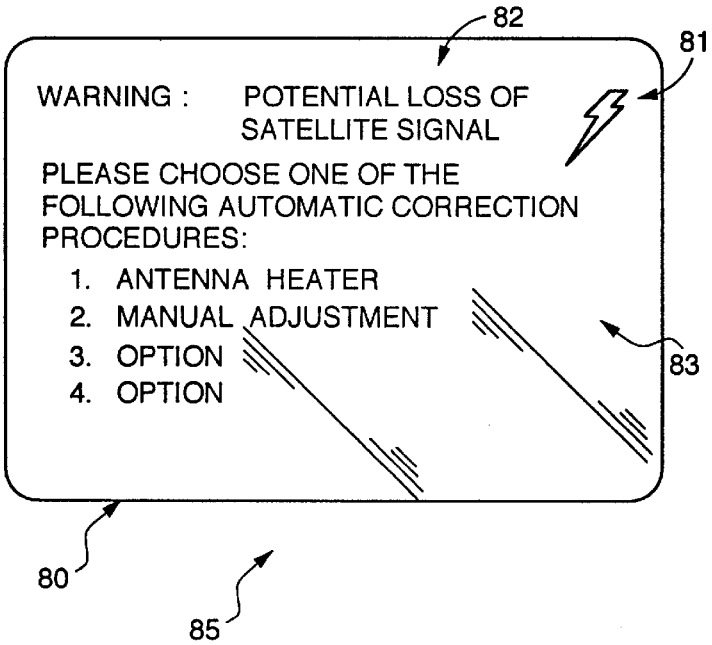

METHOD AND APPARATUS FOR DE-ICING A SATELLITE DISH ANTENNA

BACKGROUND OF THE INVENTION

The present invention relates generally to digital satellite communication systems, and more particularly to a method and system for removing snow, ice and frost from the satellite receiver dish antenna upon detection that the received signal is degrading under conditions conducive to snow, ice or frost accumulation.

Generally, in modern digital satellite communication systems, a ground-based transmitter transmits a forward-error-coded uplink signal to a satellite positioned in a geosynchronous orbit. The satellite in turn relays the signal back to a ground-based receiver antenna in a separate location. Direct broadcast satellite ("DBS") systems allow households to receive television, audio, data, and video directly from the DBS satellite. Each household subscribing to the system receives the broadcast signals through a receiver unit and a satellite dish receiver antenna.

In the typical DBS system, the satellite receiver antenna includes an e.g. 18-inch parabolic dish and a low noise block (LNB), and the receiver unit may include an integrated receiver decoder module (IRD). The receiver antenna is typically mounted outside the house, and cables are provided to link the LNB to the indoor IRD and associated equipment (e.g. video display).

Several factors can degrade received DBS signals. For example, the satellite receiver antenna can accumulate snow, ice or other debris unseen by the user. This accumulation can degrade the received signal strength enough to interrupt IRD operation. This may be a particular problem in colder climates where seasonal snow, ice or frost accumulations can degrade the performance of an antenna reflector and/or an LNB, particularly in the Ku band or other high frequency bands utilized by many present DBS and terrestrial systems. Furthermore, due to the significant amount of forward error correction used, the DBS picture quality may not suffer any noticeable decrease although signal strength is continuously degrading. When signal strength falls below a certain minimum, the signal can be completely lost without warning.

Therefore, there is a need for an inexpensive and simple method and system for automatically detecting a degraded signal and clearing snow, ice or frost from a home receiving antenna. There is a particular need for such a system which can better determine when a corrective response for snow, ice or frost accumulation is appropriate, by discriminating between signal reductions caused by these events as opposed to other possible environmental causes such as rain fade.

SUMMARY OF THE INVENTION

The present invention provides a method of controlling a snow and frost-melting heating device mounted on or near an antenna, such as a satellite receiver antenna. The method includes the steps of determining whether the signal strength is degrading, determining whether the ambient air temperature or temperature of the antenna or its environment (e.g. satellite dish and/or LNB) is below a threshold temperature, and operating a heating device located on proximate to the antenna (e.g. dish, plate, or LNB) if both the signal is degrading and the ambient air temperature or temperature of the antenna or its environment is below the threshold.

The present invention also provides a system for controlling a heating device that includes a temperature sensor that samples the ambient air around the receiver antenna (or a portion of the antenna itself), a device that measures a signal strength of a signal received by the receiver antenna, logic in communication with the temperature sensor and the device, and a switch or other device linked to the logic for operating the heater system. The logic determines whether the signal strength is degrading and whether the sampled ambient air temperature or the temperature of the antenna and/or its environment is below a threshold temperature. Preferably, the logic automatically turns on the heating device if, and only if, the ambient air temperature (or the temperature of the antenna) is below the temperature threshold and the signal strength is degrading. In certain embodiments, the device is automatically turned off after the signal strength returns to a satisfactory level, after the temperature rises above the threshold, or after the unit has reached a time limit of continuous uninterrupted heating, or otherwise.

The preferred embodiment of the system and method herein automatically turns on an antenna heating device to melt snow or frost accumulated on or proximate to the antenna upon detecting a loss of signal strength and a sufficiently low ambient air temperature or antenna temperature. The system and method provide for improved signal reception during fading conditions, particularly when the outside conditions allow frost and/or snow to accumulate on or near the antenna or otherwise to obscure or reduce the antenna's reception efficiency.

It is to be understood that both the foregoing general description and the following detailed description are exemplary and explanatory and are intended to provide further explanation of the invention as claimed.

The invention, together with further objects and attendant advantages, will best be understood by reference to the following detailed description, taken in conjunction with the accompanying drawings.

BRIEF DESCRIPTION OF THE DRAWINGS

FIG. 1 illustrates a conventional direct-to-home DBS satellite television system capable of utilizing a de-icing apparatus embodying the present invention (prior art).

FIG. 7 shows a user interface screen capable of integration with the in-line detection apparatus of the present invention.

DETAILED DESCRIPTION OF THE PRESENTLY PREFERRED EMBODIMENTS

Figure 8:
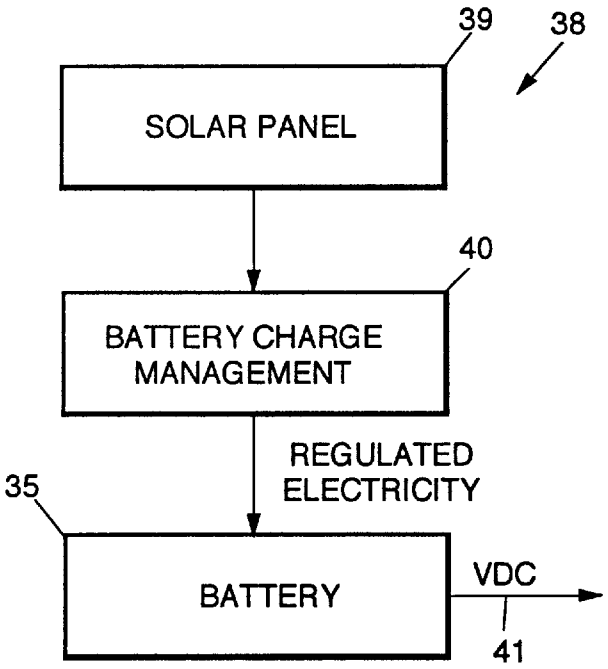
FIG. 8 illustrates a power supply system capable of being utilized with the de-icing apparatus of FIGS. 2–3.

Referring now to the drawings, and more particularly to FIG. 1, a representative digital DBS system 12 capable of utilizing the present invention is shown. The DBS system 12 preferably includes a ground-based broadcast transmitter 13, a space segment 14 that includes a satellite 15, and a ground-based subscriber receiving station 16. In an exemplary DBS system, the satellite 15 may be a geosynchronous satellite, such as the Hughes® HS-601™ spacecraft, preferably positioned at a geosynchronous orbital location. The home subscriber receiving station 16 includes an outdoor receiver antenna 19 including a low noise block (LNB) 20 connected to an indoor receiver/decoder box (IRD, not shown) via a cable (also not shown).

The broadcast transmitter 13 receives digitally modulated television or audio signals and transmits them to the satellite 15. The satellite 15 translates the signals to a downlink frequency (e.g. in the Ku band) and transmits them to the receiver antenna 19 of the receiving station 16 for subsequent demodulation. The satellite 15 transmits downlink signals via on-board transponders 17 operating at a power level of e.g. 120 to 240 watts. The LNB receives the downlink RF signals, amplifies them, and typically downconverts them (e.g. to the L-band). When the downlink signal from the satellite 15 is received in the receiver antenna 20 with sufficient signal strength to be demodulated, the satellite signal is considered to be "locked" with the receiving station 16.

In order to prevent the buildup of ice, snow, frost or similar debris on or proximate to an antenna, a preferred embodiment of a system for detecting and clearing an antenna (e.g. dish reflector and/or LNB, or a flat plate antenna) is provided as described below. The system may be mounted on or near the installed antenna and operates automatically to melt any ice, snow or frost that may accumulate on or near the antenna or portions of it. The control circuits described below may be mounted on or near the antenna, in an in-line module between the antenna and the IRD, integrated into the IRD itself, or otherwise provided.

Figure 2:
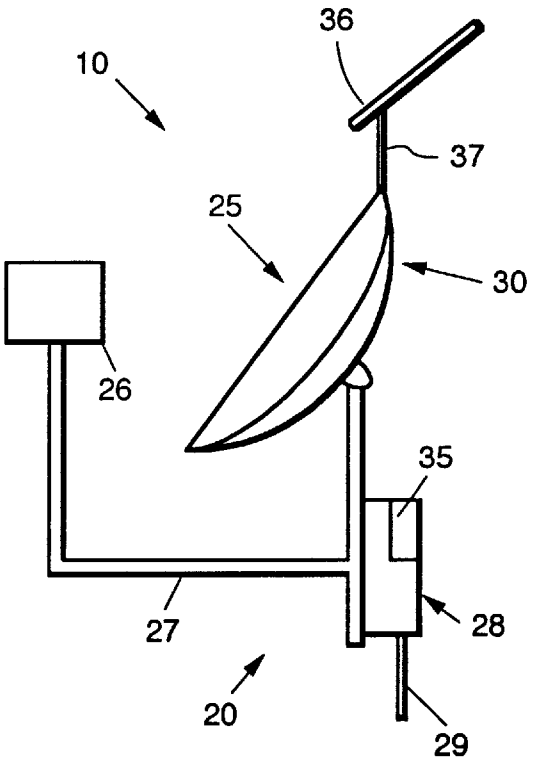
FIG. 2 illustrates the configuration and external features of the antenna-mounted components of one embodiment of a de-icing apparatus embodying the present invention.

FIG. 2 illustrates the mounted hardware elements of the preferred embodiment of the de-icing system 10 for use in a present DBS system. Most of the hardware is mounted on or near the satellite receiver dish antenna 20, which includes a parabolic dish 30, a mounting assembly bracket 27, and an LNB 26. The LNB 26 receives the focused signals (e.g. Ku band) from the dish 30, amplifies and downconverts the signals (e.g. to the L band), and sends the signals via cable 29 to the IRD inside the house. Solar panel 36 and its corresponding panel mounting bracket 37 may also be incorporated onto the structure of the antenna 20 in a fully or partiall solar powered embodiment. The logic and relay components of the system 10 and a rechargeable battery 35 may be mounted inside housing 28 attached to bracket 27. An electric power cord may be used, alternatively or in addition, to supply the unit with power, or power may be provided by means of the coaxial cable connecting the antenna to an IRD or other power source. A combination of rechargeable battery and electric power cord may also be used to jointly provide the unit with power.

It should be understood that the present invention may be utilized in conjunction with a wide variety of corrective devices, including any known or future form of antenna heating; physical or mechanical ice, snow or frost clearance; or the like. Further, the present device may be used to activate preventative devices, such as snow shields, enclosures, or the like. Devices other than snow removal systems may also be controlled, without departing from the scope of certain aspects of the present invention.

Figure 3:
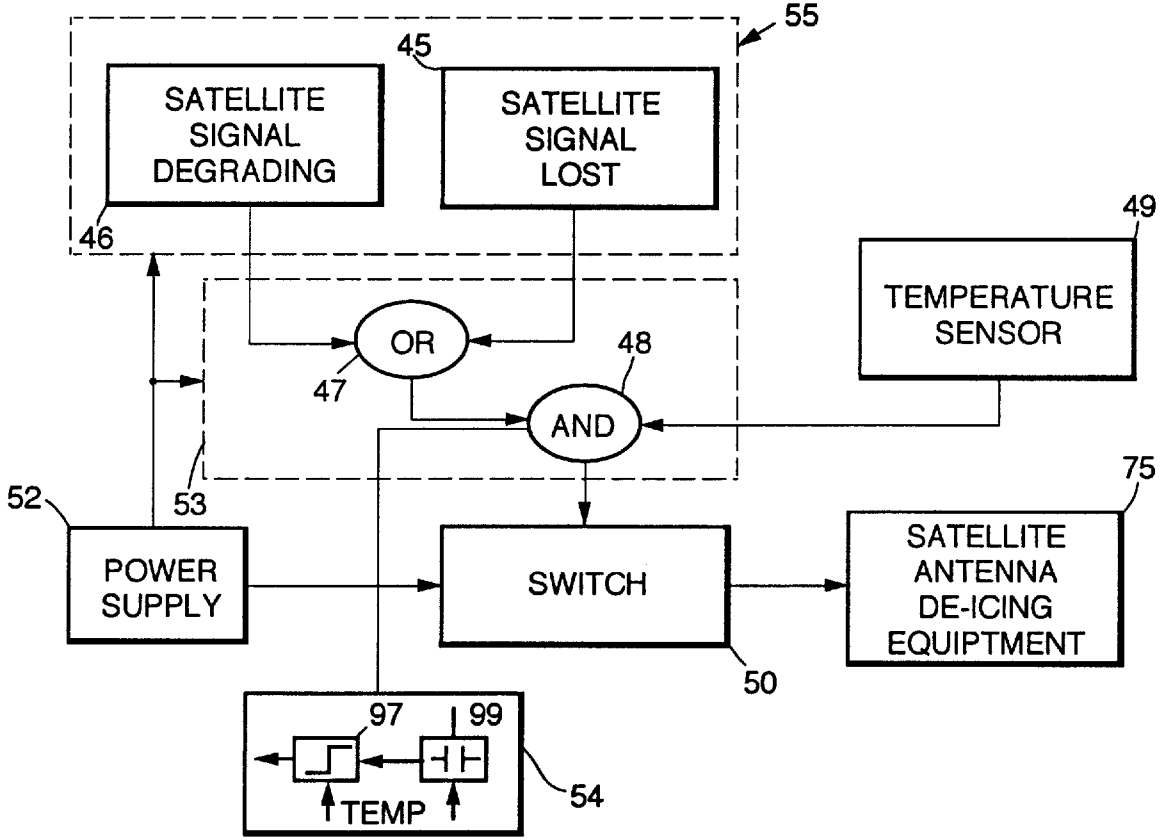
FIG. 3 illustrates the components of a de-icing apparatus embodying the present invention.

The components of a representative de-icing system 10 incorporating aspects of the present invention are illustrated in the block diagram of FIG. 3. A subsystem 55, to be described in more detail below, is provided for determining whether the received satellite signal is degrading or lost, and is linked to triggering the logic 53. A conventional temperature sensor 49, which preferably includes a probe (not shown) attached to the antenna 20, is also linked to logic 53. The logic 53 may be linked to a switch, preferably an electronic switch 50, which may in turn be linked to a heater device 75 or the like mounted on the antenna 20. A power supply 52 powers the logic 53 and the subsystem 55. Other forms of controllable switches or relays may likewise be used.

The design and implementation of suitable logic components for logic 53 that will perform the functions described herein are well within the capabilities of a person skilled in the art. The logic 53 thus operates through conventional means known in the art, such as through combinatorial logic, to trigger the switch 50 and the heater 75. Other forms of logic, including PLA, or processors under appropriate firmware or software control, may likewise be used.

During operation, the subsystem 55 monitors at least periodically the incoming satellite signal from the receiver antenna 20 and determines whether the received signal is degrading or lost, and sends a control signal to logic block 47. This is an indication to the system 10 that reception by the satellite dish 30 may be impeded, which may occur as a result of (or among other possible causes) a developing accumulation of ice, snow or frost. In association with this determination, logic 53 further determines whether the ambient air temperature or the temperature of the satellite dish as measured by, e.g., temperature sensor 49 is below a selected threshold temperature. This threshold temperature may be selected to be near (e.g. at, slightly below, or preferably slightly above) zero degrees Celsius. If the ambient or dish temperature is below the threshold, logic block 48 triggers switch or other control device 50 to operate the heater 75. Alternatively, the ambient air temperature may be sampled at regular time intervals, independent of the subsystem 55. Importantly, the mere occurrence of low temperature will not unnecessarily cause the heater to operate, if there is no concurrent degradation of received signal strength. Conversely, the mere occurrence of reduced signal strength (e.g. as caused by rain fade) will not cause the de-icer to operate when temperatures are such that ice, snow or frost accumulation is not a likely cause.

Figure 4:
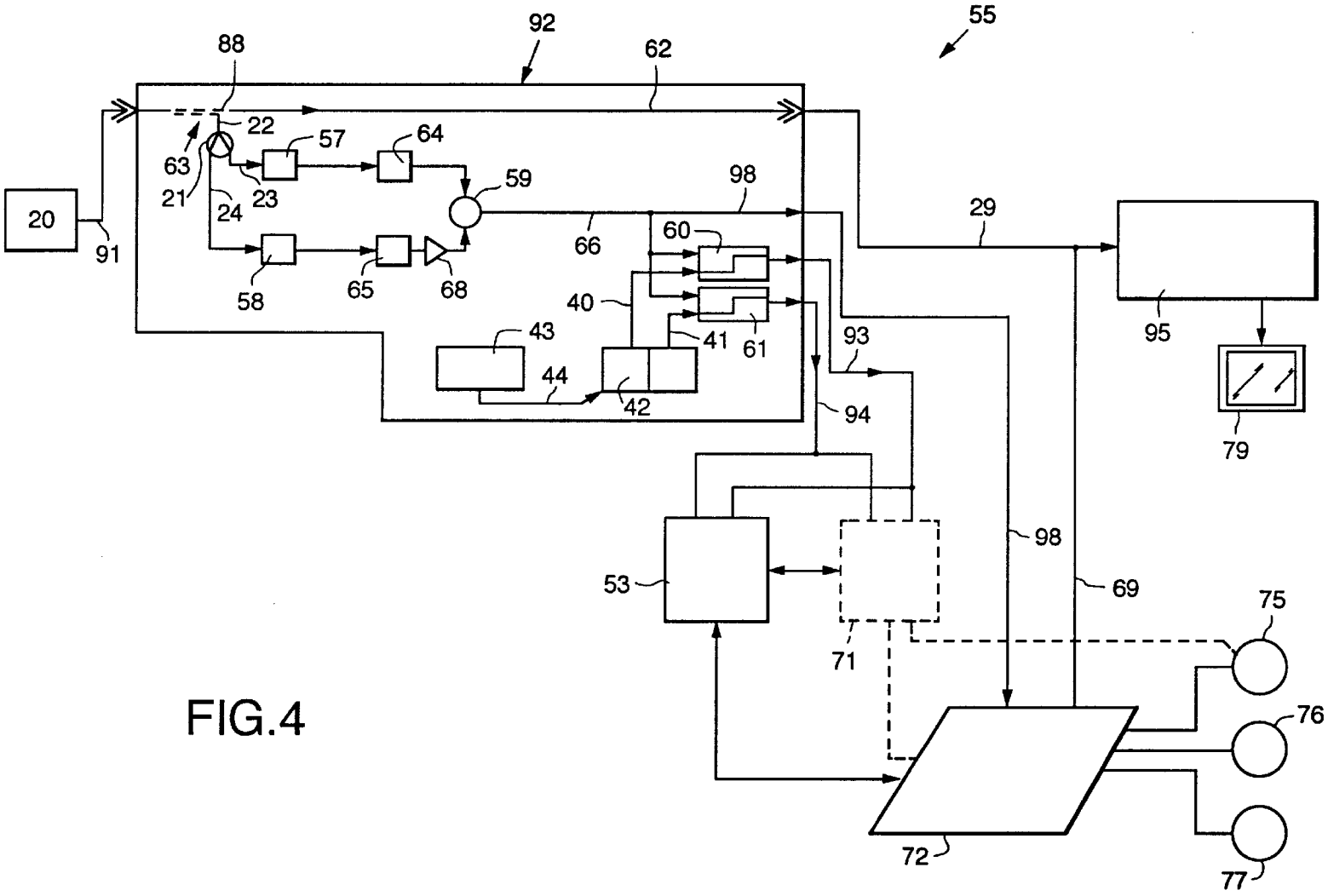
FIG. 4 is a diagram of an embodiment of the in-line detection apparatus according to the present invention.

In order to determine whether the received satellite signal is degrading or lost due to snow, ice frost or any other reason, a lock-detect subsystem 55 for monitoring satellite signal lock is preferably provided. As shown in FIG. 4, the outside line 91 from the LNB 20 is connected to a lock detector 92 at an input 63. The input 63 preferably feeds a tap or coupler 88. A line 62 allows a portion (preferably a majority, e.g. 90 percent) of the LNB signal to pass through the detector 92 to the cable 29 and the IRD 95 regardless of whether the lock detector 92 or IRD 95 power is on or off. A portion 22 of the LNB signal is fed to a pair of filters 57 and 58. Filter 57 is a signal or service frequency filter, and filter 58 is a noise frequency filter. Preferably the portion 22 of the LNB signal fed to the filters is a relatively small percentage of the total LNB signal (e.g. 10 percent). A splitter may be used to divide the portion between the respective filters.

In the specific embodiment illustrated, the output of filter 57 is passed to a radio frequency RF detector 64, which in turn is linked to an adder circuit or summer 59. The output of filter 58 is passed to a second RF detector 65, and to an inverter 68. The inverter 68 output is coupled to summer 59.

The RF detectors 64 and 65 convert the measured average RF power level outputs of the filters 57 and 58 to obtain two representative output signals, e.g. DC voltage levels. The output signal 66 of summer 59 is supplied to one or more comparators, such as a pair of comparators 60 and 61. The outputs 93 and 94 from the comparators 60 and 61, respectively, may be functionally connected to one or more of indicator devices, logic 53 or switch 71.

Although preferably only signal or service frequencies are passed, it should be understood that in certain embodiments a limited amount of noise may also be passed, so long as the signal is predominantly comprised of service frequencies.

The filter 58, in contrast, passes only a range of noise frequencies corresponding to a known region in the received spectrum where no service band or channel is present. Once again, although it is preferred that filter 58 pass only background noise components, in certain embodiments a limited amount of signal or service frequencies may also be passed, so long as the passed signal is predominantly comprised of noise (non-service) frequencies.

Figure 5A:
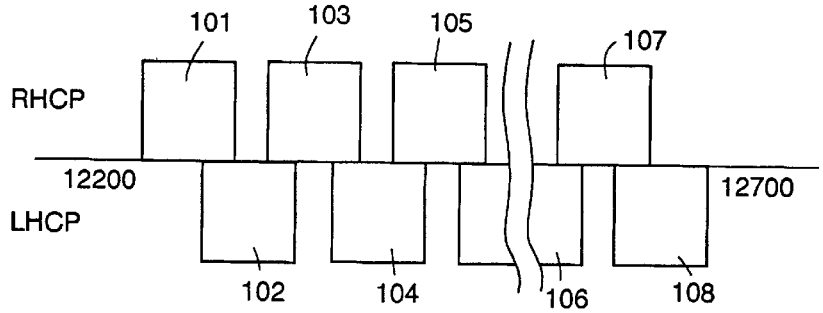
FIGS. 5 (A–E) illustrate exemplary DBS broadcast frequencies, and preferred embodiments for the service signal and noise filter characteristics usable in one embodiment of the present invention.

FIGS. (A–E) illustrate preferred embodiments of frequency characteristics for filters 57, 58 in the context of a representative Ku band DBS system. FIG. 5(A) illustrates a typical downlink frequency utilization for a system having a plurality of transponders, each with an assigned frequency band (e.g. 101–108). In the system illustrated, these transponder signals (which may number e.g. 32) are located in a 500 MHz portion of the Ku band, e.g. between 12.2 and 12.7 GHz. As is known in the art, the signal carrying capacity within this assigned band can be increased by utilizing polarization multiplexing, e.g. right hand circular polarization (RHCP) and left hand circular polarization (LHCP). In the system illustrated, frequency bands for those transponders assigned to RHCP (101, 103, 105 and 107) are interleaved in a "staggered" fashion with those assigned LHCP (102, 104, 106 and 108). In general, the center frequency of a RHCP band (e.g. 103) corresponds to the center of a guard band lying between two adjacent LHCP transponder frequencies (e.g. 102, 104).

Figure 5B:
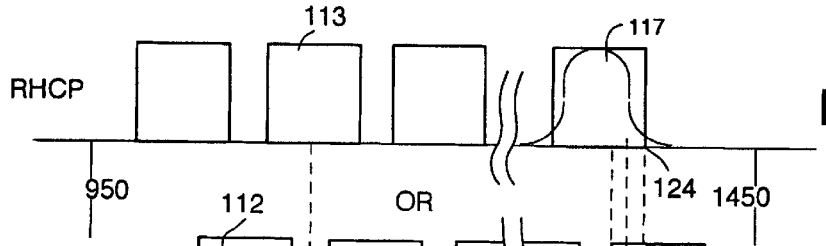
Figure 5C:
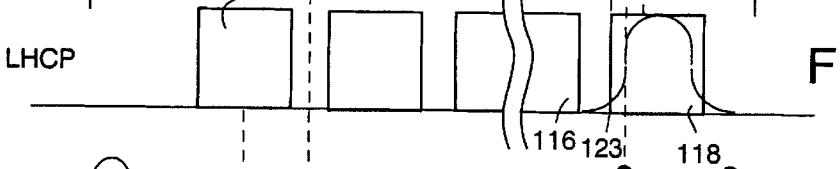

In manners known in the art, the LNB receives both RHCP and LHCP signals, but is configured electronically (or, in less preferred embodiments, mechanically) to discriminate and process only one of the respective polarization. This signal is then typically down-converted in frequency to a 500 MHz portion of e.g. the L band, such as the spectrum between 950 MHz and 1.45 GHz. The LNB output will therefore correspond to the signal shown diagramatically in FIG. 5(B) if the LNB is configured to process RHCP signals, or the output shown in FIG. 5(C) if the LNB is configured to process the LHCP signals.

Figure 5D:
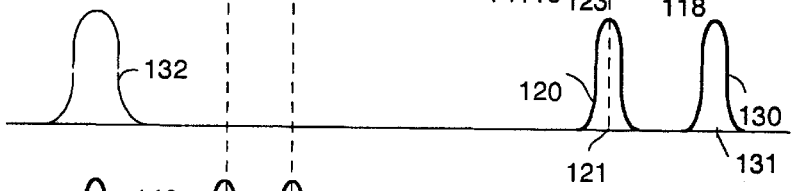

The filter characteristics for filters 57, 58 are preferably chosen to support this frequency/polarization utilization scheme, permitting the lock-detect system 55 to function with standard equipment in commercial products and support their complete functionality, including LNB selection of RHCP or LHCP signals. FIG. 5(D) illustrates preferred filter characteristics. The signal or service frequency filter 57 has a passband center frequency 121 which preferably corresponds to the approximate middle frequency between the outer boundary (e.g. 124) of a selected RHCP transponder frequency band (e.g. 117), and the complimentary outer boundary (e.g. 123) of an overlapping LHCP transponder frequency band (e.g. 118). By selecting a filter passband corresponding to an "overlap" between the staggered RHCP and LHCP bands, a single filter (as illustrated in FIG. 4) can function to isolate service frequencies regardless of whether the LNB is processing RHCP or LHCP signals. In a known DBS system utilizing 32 equal transponder bands staggered between 12.2 and 12.7 GHz, the center frequency of the signal or service frequency filter 57 may be chosen to lie within the region of overlap between any adjacent LHCP and RHCP transponders, e.g. at $C_f \pm 7.29$ MHz, where $C_f$ is the center frequency of a particular transponder.

The bandwidth or passband characteristic 120 of filter 57 is preferably selected to reduce susceptibility to variations in transponder roll-off characteristics from one transponder to the next, as well as variations in LNB local oscillator frequency. In general, it is desirable to provide a passband and roll-off characteristic to maximize the amount of signal (whether RHCP or LHCP) which is passed, while minimizing inclusion of noise signals in the adjacent guard band. In the representative system previously described, a standard 6 MHz wide bandpass filter may be used. Such filters are common in the cable industry.

Referring still to FIG. 5(D), the noise frequency filter 58 preferably passes a band of frequencies lying above (or below) the highest (or lowest) transponder band, and also below (or above) any neighboring spectrum allocation. By way of specific example, a known Ku-band DBS system operates within a 500 MHz band between 12.2 and 12.7 GHz. The LNB downconverts the signals to the L-band, between 950 and 1,450 MHz. A guard band of approximately 12 MHz separates the highest (and lowest) transponder band from the upper (and lower) limits of the assigned spectrum. This separation provides protection from interference by neighboring services, and should contain no intelligence-carrying signals.

Accordingly, it is preferred to select the passband characteristics of the noise filter 58 to correspond with one or both of these guard bands. A representative characteristic 130 is shown, with center frequency 131. The bandwidth of filter 58 is not critical (although preferably narrow enough to exclude signal frequencies). It may also be desirable to select a passband which is easily and inexpensively implemented, and which results in noise power levels having a value (when discriminated, as discussed below) in an appropriate range for ease of processing. In a preferred embodiment, the standard 6 MHz bandpass filter common in the cable industry may similarly be employed. As shown, the noise filter may have a greater or lesser passband (e.g. as shown in alternative 132), or noise signals could be derived from elsewhere.

Figure 5E:
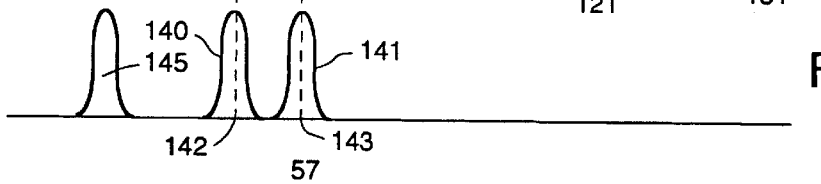
Figure 6:
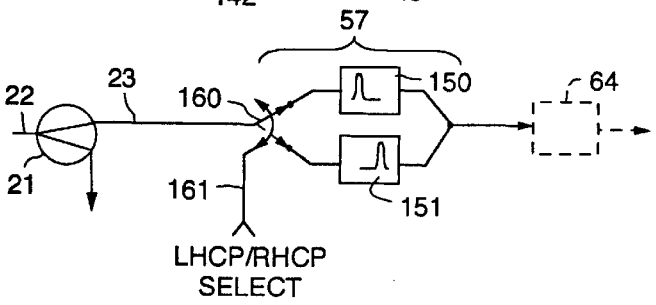
FIG. 6 shows an alternative embodiment of a portion of the embodiment of FIG. 4, corresponding to the embodiment illustrated in FIG. 5 (E).

An alternative embodiment for accommodating selective polarizations in a staggered-frequency system is shown in FIG. 5(E) and FIG. 6. Service frequency filter 57 comprises a pair of individual bandpass filters 150, 151. Filter 150 has a passband characteristic 140 with a center frequency 142 preferably approximately centered within the transponder band (e.g. 112) of a first polarization (e.g. LHCP). The second filter 151 has a passband characteristic 141 with a center frequency 143 corresponding to the approximate center of a transponder band (e.g. 113) in the alternate polarization (e.g. RHCP). Although it is preferable for the filter passbands to be approximately centered within transponder bands, it should be understood that this is not essential so long as the passbands fall within the transponder bands. The filter characteristics are shown aligned with the adjacent LHCP and RHCP transponder bands. This is the preferred implementation in order to reduce the impact of any variation in the gain of the system over frequency.

However, it is not necessary that adjacent bands be utilized, and any LHCP and RHCP band or bands could alternatively be selected. More than one may be used, with the signals either combined (for greater total signal) or averaged. When two or more are used and averaged, the resulting system is tolerant of the loss of a transponder, without adjustment. The specific filter characteristics and passbands are not critical, although they preferably fall within the transponder bands with minimal or no inclusion of noise signals in the guard bands. 6 MHz filters may be used for convenience, or filters having a wider passband (e.g. 20 MHz with a rolloff of−25 db at±12 MHz) may be used to pass more received power. As with the previous embodiment, the noise component may be filtered preferably above or below the signal band (e. g. 145).

Referring again to FIG. 6 and to FIG. 4, the signal 23 may be provided to a switch 160 whose outputs are in turn connected to filters 150, 151. The is state of switch 160 is determined by a select input 161, which preferably corresponds to the LNB control signal for selecting RHCP or LHCP output. In known systems, a first DC voltage level (e.g. 13 volts) is provided for a first polarization state, and a second DC voltage level (e.g. 17 volts) is provided for the alternate polarization state. These DC voltages provide control inputs to the LNB for selecting LHCP or RHCP output, and provide power to the LNB electronics. In a preferred embodiment, the same control voltages are utilized by the lock-detect subsystem 55 for determining the state of switch 160, and also for providing necessary power to the circuits of the device.

Although the foregoing specific embodiments illustrate operation of the present invention by utilization of certain frequencies, it should be understood that other signal and/or noise frequencies may alternatively be utilized.

Referring again to FIG. 4, the service frequency component is output from the filter 57 and supplied to the RF detector 64 for e.g. voltage conversion before being fed to summer 59, while the noise frequency component output from the filter 58 is fed to RF detector 65. The RF detectors may comprise any known devices and methods for generating outputs which are proportional to the power level of the input RF signals. Although simple analog components are preferred, digital or hybrid analog/digital circuits may alternatively be used. For example, the detectors may comprise A/D converters to convert the detected DC levels to digital format for subsequent processing.

In the preferred embodiment illustrated, one of the detected DC voltage (preferably corresponding to noise signals) is inverted by inverter 68, and supplied to the adder circuit 59. The summer 59 sums the voltage data and outputs a difference signal level value at output 66. Alternatives may likewise be utilized for generating an output proportional to the difference between the respective RF power levels. For example, a voltage subtractor may be used in place of the inverter and adder. If digital conversion is used, a digital adder or substractor may be used, or a microprocessor may determine the desired difference value.

The output indicative of power difference is supplied, in a preferred embodiment, to a pair of step function comparators 60 and 61. The comparators 60 and 61 evaluate the difference in power levels of the signal and noise components. The comparator 60 determines whether the value is greater than a satellite signal loss threshold, which may be input 40 or otherwise provided. The satellite signal loss threshold is preferably settable and set sufficiently above the noise floor to represent the minimum signal level at which an acceptable satellite lock may be achieved in a given system, setup, and location. The received signal strength in a typical DBS system will vary from one region to another, and may be influenced by antenna location, installation and other variable factors. It is therefore preferable to have a lock threshold that can be adjusted to match the specific performance standards for a given installation.

The other comparator 61 in turn determines whether the value is greater than an intermediate threshold which may be input 41 or otherwise provided. The intermediate threshold is set sufficiently above both the noise floor and the signal loss threshold. The intermediate threshold preferably represents an intermediate signal strength level at which secure satellite lock is achieved. Other thresholds may also be provided, above or below the lock threshold. If digital conversion is used, the comparator(s) may comprise any known hardware or software-implemented comparison or difference detection.

The comparator(s) may be provided with fixed thresholds selected, e.g., to represent a state of degraded performance or of signal loss. The thresholds may be preset for certain locations or configurations, or normal operating conditions. In general, the signal to noise (S/N) ratio at the lock/unlock threshold will be independent of geographic location. It may nevertheless be desirable to have adjustable thresholds, to permit optimization for e.g. a particular receiver.

It may also be particularly beneficial to have adjustable intermediate threshold(s) which can be set, preset, or adjusted for optimum operation in a particular location. For example, where the received signal strength is higher, it may be desirable to set a higher intermediate threshold to provide maximum warning of an impending loss of signal. However, where the clear sky received signal strength is lower, the same intermediate threshold may result in an excessive number of "false alarms", and a lower intermediate threshold (closer to the loss of lock threshold) may be appropriate.

In particular embodiments, different thresholds may be utilized for different transponders within the assigned spectrum. By way of example, one known commercial DBS system utilizes 16 high power transponders transmitting at 240 watts, and 16 lower powered transmitters at 120 watts. The S/N ratio differs for the low and high powered transponders. To permit optimized operation, appropriate thresholds can be used depending on the nature (e.g. power) of a transponder whose signal is being utilized. In these embodiments, of course, it is necessary to know which transponder the IRD is tuned to. In systems where the low/high power status of the transponders corresponds to the LNB polarization states (e.g. where all LHCP signals are broadcast by low power transponders, and all RHCP signals are broadcast by high power transponders), the polarization-select DC voltage may be used to also select appropriate thresholds. Other control signals or schemes could alternatively be used. In other embodiments, a single threshold (e.g. high power threshold) may be used for both transponders, providing adequate operation for many applications.

The comparators 60, 61 may be provided with external threshold inputs 40, 41. The thresholds may be generated by a threshold generator 42. In embodiments where comparators 60, 61 are analog devices, thresholds 40, 41 may be voltage levels output by the threshold generator 42. In preferred embodiments, threshold generator 42 provides adjustable threshold(s), and may comprise a manually adjustable trim resistor or resistor array. In this manner, manual adjustments can be made to tailor the device operation to a given region, equipment or installation.

In other embodiments, a D/A converter may be used. One or more digital words may then be input 44 from a source 43.

The source 43 may comprise a predetermined memory (e.g. ROM) or variable memory (e.g. RAM or binary dip switches). In certain embodiments, the threshold values may be downlinked directly from the satellite 15 and stored in a buffer or memory. In particular embodiments, the threshold value may be adjusted by means of an on-screen user interface (e.g. by providing threshold generator 42 with suitable means for receiving signals from the user interface or associated circuits). Combinations are also possible. For example, a threshold value may be downlinked to the lock detector 92 and stored in memory 43, then later adjusted (e.g. incremented or decremented) by local adjustment (e.g. manual inputs via the user interface). Further, the thresholds may be adaptive relative to other inputs. For example, some (e.g. the intermediate) or all of the thresholds may be adjusted when temperatures fall below certain levels, to render the device more sensitive to reductions in signal strength that may be caused by temperature-related conditions (e.g. ice accumulation).

Where a plurality of detectors are utilized, each having a threshold, one or more of the thresholds may be derived from other(s) of the thresholds. For example, a first threshold value can be provided from satellite 15, input manually, or read from a memory or other source, e.g. 43. The other threshold value(s) may then be derived from the first threshold, for example, as a certain percentage or other function of the first threshold.

Some or all of the thresholds can also be region-specific in that the locally stored or the downloaded threshold is dependent on the zip code or other indicator (e.g. latitude and longitude) of where the IRD is installed. In one preferred embodiment, threshold values may be stored in memory corresponding to individual or preferably groups of zip codes. Other regional or geographic correlations may similarly be utilized to select desired thresholds for different geographic regions.

The comparators 60 and 61 generate control voltages or other signals that represent the result of each comparison operation. The control voltages are present on outputs 93 and 94. By way of example, a first level voltage at the output 93 may indicate that the satellite signal is not locked, or has fallen below the satellite signal loss threshold (e.g. as the result of an excessive accumulation of snow, ice or frost). A first level voltage at output 94 may indicate that the satellite signal has fallen below the intermediate threshold and is approaching the satellite signal loss threshold (e.g. as an accumulation of snow, ice or frost is developing). This output 94 voltage may serve to warn users or the logic 53 of potential loss of the signal. Additional comparators may be utilized to give the lock-detector the capability to implement additional thresholds.

The control voltages output at 93 and 94 from comparators 60 and 61 can be used to issue commands via an output link such as switch unit 71 or directly to an external device 75, such as a de-icer or the like. The lock-detect apparatus 92 can thus automatically activate, for example, a corrective cycle to melt accumulated ice or snow which is degreading reception in response to degrading signal conditions. Because the apparatus 92 may operate independently of the receiving apparatus, such as IRD 95, the receiving apparatus need not be operating in order for the apparatus 92 and external device (e.g. heater) to operate. Thus undesirable accumulations of snow, ice or frost are prevented even when the user is not presently using the system, so the system is always ready for use when desired.

Referring now to FIGS. 4 and 7, the output(s) of the comparators may be further linked to a user interface generator 72. The generator 72 in turn has a feed line 69 linked directly to cable 29, which, as described previously, is linked to the IRD 95 and television set 79. The direct output 66 from the summer 59 may also be linked via output 98 to the interface generator 72, to provide a difference signal value output 66 for use in signal strength calculations in a generated signal strength meter.

Upon detecting a signal (e.g. from switch unit 71 or logic 53, or directly from outputs 93 and/or 94) indicating a signal degradation, the interface generator 72, through conventional means known in the art, sends a signal through the cable 29 to the IRD 95. The IRD 95 in turn preferably causes a visual or aural response, such as a small icon 81, to be generated by the television set 79 or the IRD itself.

The user can then use a remote control (not shown) to cause the generator 72 to control a user interface, preferably an on-screen user interface such as shown in FIG. 7, through conventional means known in the art. This user interface 85 preferably comprises a menu 80 to explain to the user the various options 83 available to correct the degradation of the satellite signal. In one particular example related to snow, ice or frost accumulation, an antenna heater or other de-icer or preventative device can be activated by choosing its respective menu option or otherwise. In certain embodiments, once the selected external device, such as a de-icer 75, has been activated through the user interface 85, the selected device (s) may cause the user interface generator 72 to reset. The generated menu 80 and icon 81 are thus removed from the screen. In the meantime, the satellite lock detector 92 may continue to monitor the incoming signal from the LNB 20, and may cause the generator 72 to generate the icon 81 again if the corrective device is not successful in improving the satellite signal strength. Many other uses and options are likewise possible.

In certain embodiments, the dual thresholds may be used to trigger a multiple-state correction device. For example, the first signal loss threshold can trigger a heating device cycle for a pre-determined amount of time. A second, higher threshold of signal loss can trigger a second, longer heating cycle in an attempt to correct varying degrees of, for example, ice obstructions.

Other particular embodiments may include the generation of a signal strength meter (not shown) on the screen, which may in preferred embodiments utilize the difference signal strength output 66 from the summer 59 to produce a bar graph or similar graphic. The signal strength meter can be monitored during the execution of a corrective device's operation to evaluate the effectiveness of the measure, e.g. to monitor whether the accumulation of ice, snow or frost is melting and the signal therefore improving. The signal strength meter may be generated by the interface generator 72 through conventional means, or generated by the IRD 95 upon a specified control signal fed by the direct output 66 from the summer 59, which is linked via output 98 to generator 72.

In certain embodiments, the user may also utilize the user interface menu 80 to manually adjust various parameters of the system 10. In particular, the levels for the lock-detect threshold values and the levels for the warning signals given by the system to indicate signal degradation, including brightness and sound volume, may be set manually or using the user interface menu 80.

Preferably, the present embodiment of the lock detector 92 and de-icer controller are adapted for use with a variety of systems such as DBS direct-to-home satellite receiver systems. For example, a user may purchase the de-icing system in combination with the DBS IRD/antenna system, or as an accessory to retrofit an existing DBS system. The de-icing controller may be sold with an antenna heating or similar system, or may be sold as an accessory for use with existing heaters and the like. The lock-detect device and other control electronics preferably may be installed in any easily accessible area between the LNB and the indoor IRD unit. The methods and apparatus may also be employed in other RF transmission systems, such as LMDs, MMDs or other terrestrial broadcast services whose signals may be degrated by environmental factors such as snow, ice or frost.

Preferably the subsystem 55 of FIG. 4 issues a command signal to the logic 53 if the difference signal value is below the threshold value to indicate to logic 53 that the signal strength is degrading. In the alternative, various methods, such as microprocessor circuits, can be used to measure and monitor the received signal strength at the antenna 20 and determine whether the strength is degrading. This may be accomplished by using various methods for measuring the signal strength at various time intervals and comparing the measurements with the thresholds necessary for decoding the signal at the IRD.

The heating device or de-icer is preferably activated until either the received signal strength rises or the satellite dish or ambient temperature rises. However, a timer preferably may monitor the duration of continuously applied heat to establish a maximum time period for the heater to be powered. Referring to FIG. 3, conventional timer 54, included as part of the logic 53, can be adjusted to gate power to the heater 75 for varying periods of time either manually or automatically based on the ambient air temperature or temperature of the satellite dish as detected by the voltage level detector 97 and slow charge capacitor 99. Thus, if the ambient air temperature or temperature of the satellite dish antenna 20 is colder, the heater 75 may be turned on for a longer period of time to correct ice or frost problems. In other embodiments, the heater energy (e.g. voltage to resistive heater elements) may be adjusted in response to temperature and/or the amount of signal degradation. However, heat may only be required while the temperature and satellite signal are below their respective thresholds, not necessarily for the full duration of the permitted time period. In the alternative, the timer 54 may be eliminated, and the logic 53 and the lock-detect subsystem 55 can be configured to turn down or off the heater 75 when the received signal strength is no longer degrading. For example, upon activation of the heater 75, the received signal strength will increase as ice on the dish antenna 20 melts. When the signal strength elevates above the signal strength threshold in the subsystem 55, the control signal to the switch 50 will cease.

An optional cordless power supply system for use with the preferred embodiment of the invention is shown in FIG. 8. The power supply system 38 is preferably housed near the antenna 30, and includes a solar panel 39, battery charging logic 40, and a battery 35. The system 38 can be any battery storage and charging system which maintains the charge in the battery 35. Preferably, the system 38 periodically measures the charge in the battery 35 and diverts power from the solar panel 39 to the battery 35 when the battery 35 when the battery 35 has been partially or entirely depleted. In the alternative, or jointly, power may be supplied to the battery 35 via an outdoor AC or DC power connection. In particular, a low-voltage DC line can be run parallel to the LNB cable 29 indoors in order to supply power to the heater equipment 25. Power may also be supplied by cable 29, or by a separate connection to a remote supply, without need for solar panels or batteries.

The method and system of the present invention allows a user of a system such as a direct-to-home DBS system to conveniently optimize operation of the associated antenna even during adverse cold weather seasonal conditions, by automatically melting snow, ice or frost accumulated on or near the antenna. By monitoring both the satellite signal lock and the ambient air temperature or temperature of the satellite dish, the heater operates only when frost or snow is likely to be present in sufficient amounts to affect adversely the received signal. Thus, the method and system operates only when it is necessary to improve the received signal strength, thereby minimizing power consumption and wear on the system components, and avoiding potential damage due to overuse (e.g. battery depletion or overheating). Furthermore, because the system can operate independently of the receiver, the antenna can be maintained in a thawed state even when the receiver is turned off. Also, the independent system may be retrofitted onto existing systems from various manufacturers.

Of course, it should be understood that a wide range of changes and modifications can be made to the embodiments described above. For example, any number of thresholds may be used to indicate to the user specific levels of received signal strength. As an additional example, these varying thresholds for the signal strength and temperature comparisons may be established in order to operate the heating equipment at varying time and temperature intervals. Furthermore, the entire system may be integrated with the IRD and sold with the direct-to-home receiver system. It is therefore intended that the foregoing detailed description be regarded as illustrative rather than limiting and that it be understood that it is the following claims, including all equivalents, which are intended to define the scope of this invention.

What is claimed is:

1. A method of controlling a heating device mounted on a satellite receiver antenna for receiving a signal having a signal characteristic, the method comprising the steps of:

determining whether said signal characteristic is degrading;

determining whether a temperature is below a threshold temperature; and operating a heating device if said signal characteristic is degrading and said temperature is below said threshold.

2. The method as recited in claim 1 wherein said step of determining whether said signal characteristic is degrading further comprises the steps of:

establishing a signal threshold value between a satellite signal level and a noise level;

combining a first value indicative of a noise frequency component of the satellite signal with a second value indicative of a service frequency component of the satellite signal to obtain a difference signal value;

comparing the difference signal value with the signal threshold value; and triggering said heating device if the difference signal value is below the signal threshold value.

3. The method as recited in claim 2 wherein the step of operating the heating device based on said comparison further comprises turning on the heating device if said temperature is below said temperature threshold and said signal strength is degrading.

4. The method as recited in claim 3 wherein the step of operating the heating device based on said comparison further comprises turning off the heating device after a predetermined period of time.

5. The method as recited in claim 4 wherein said temperature further comprises the air temperature adjacent said antenna.

6. The method as recited in claim 4 wherein said temperature further comprises the dish temperature of said antenna.

7. A method of controlling a heating device mounted on a satellite receiver antenna, said receiver antenna for receiving a signal from a satellite, said signal having a signal strength, the method comprising the steps of:

establishing a signal strength threshold and a temperature threshold;

sampling said signal strength of said signal and a temperature;

comparing said signal strength with said signal strength threshold;

comparing said temperature with said temperature threshold; and operating said heating device for at least a period of time, said operation based on both said signal strength threshold comparison and said temperature threshold comparison.

8. The method as recited in claim 7 wherein said temperature further comprises the air temperature adjacent said antenna.

9. The method as recited in claim 8 wherein said temperature threshold is less than or equal to 0 degrees centigrade.

10. The method as recited in claim 7 further comprising the steps of:

providing a satellite receiver unit; and sending information indicative of said temperature to said receiver unit.

11. The method as recited in claim 10 wherein the step of sampling the signal strength of said signal further comprises the steps of:

establishing a signal threshold value between a satellite signal power level and a noise power level;

combining a first value indicative of a noise frequency component of the satellite signal with a second value indicative of a service frequency component of the satellite signal to obtain a difference signal value representative of the difference in power levels of said components;

comparing the difference signal value with the signal threshold value; and triggering said heating device if the difference signal value is below the signal threshold value.

12. The method as recited in claim 10 wherein the step of comparing the signal strength with said signal strength threshold further comprises the step of determining whether said signal strength is less than said signal strength threshold.

13. The method as recited in claim 12 wherein the step of comparing said temperature information with said temperature threshold further comprises the step of determining whether said temperature is less than said temperature threshold.

14. The method as recited in claim 13 wherein the step of operating the heating device based on said comparison further comprises turning on the heating device if said temperature is below said temperature threshold and if said signal strength is below said signal strength threshold.

15. The method as recited in claim 14 wherein the step of operating the heating device based on said comparison further comprises turning off the heating device after a predetermined period of time.

16. A system for controlling a heating device mounted on a satellite receiver antenna, the system comprising:

a temperature sensor that samples the temperature of said receiver antenna;

a device that measures at least one signal characteristic of a signal received by said receiver antenna;

logic in communication with said temperature sensor and said device, said logic determining whether said signal characteristic is degrading and whether the sampled temperature is below a threshold temperature; and a switch linked to said logic for operating said heating device.

17. The system as recited in claim 16 wherein said logic turns on the heating device if said temperature is below said temperature threshold and said signal characteristic is degrading.

18. The method as recited in claim 17 wherein said logic turns off the heating device after a predetermined period of time.

19. The system as recited in claim 18 further comprising:

a rechargeable battery linked to said heater system and a solar panel for supplying power to said battery.

20. A method of controlling a heating device mounted on a satellite receiver antenna, said receiver antenna for receiving a signal from a satellite, the method comprising the steps of:

establishing a first signal characteristic threshold and a second signal characteristic threshold;

sampling said signal;

deriving a value indicative of a signal characteristic;

comparing said value with said first threshold and said second threshold; and operating said heating device based on said comparison.

21. The method as recited in claim 20 wherein said heating device is operated for a first duration if said value is between said first and second thresholds, and said heating device is operated for a second duration if said value is less than both thresholds.

22. The method as recited in claim 20 further comprising:

triggering a warning if said value is lower than said first threshold; and triggering said heating device when said value is lower than said second threshold.

23. An accessory device for use with a satellite receiver system including a satellite antenna and a satellite receiver, said device comprising:

a measuring device that measures a characteristic of a signal received by said satellite antenna, said measuring device separate from said satellite receiver, and linked to said satellite antenna to receive a signal from the satellite antenna;

logic in communication with said measuring device, said logic determining whether said signal characteristic is degrading;

the satellite antenna also linked to said satellite receiver;

a heating device mounted to said antenna; and a switch linked to said logic for operating said heating device upon a predetermined amount of degradation of said signal characteristic.

24. An accessory device for use with a satellite receiver system, said device comprising:

a measuring device that measures a characteristic of a signal received by a satellite antenna and provided to said receiver, said characteristic being derived from a service frequency component and a noise component of a received signal;

logic in communication with said measuring device, said logic determining whether said signal characteristic is degrading;

the satellite antenna also linked to said receiver;

a heating device mounted to said antenna; and a switch linked to said logic for operating said heating device upon a predetermined amount of degradation of said signal characteristic.

25. An accessory device for use with a satellite receiver system, said device comprising:

measuring device that measures a characteristic of a signal received by a satellite antenna and linked to said receiver;

a temperature sensor that samples the temperature of said antenna;

logic in communication with both said measuring device and said temperature sensor, said logic determining whether said signal characteristic is degrading and whether the sample temperature is below a predetermined threshold temperature;

the satellite antenna also linked to said receiver;

a heating device mounted to said antenna; and a switch linked to said logic for operating said heating device upon a predetermined amount of degradation of said signal characteristic.

* * * * *